United States Patent [19]

Horvath

[11] 3,949,887

[45] Apr. 13, 1976

[54] SAILPLANE STORAGE SYSTEM

[76] Inventor: Laszlo Horvath, 3108 Fairway Drive, Tempe, Ariz. 85282

[22] Filed: Sept. 5, 1974

[21] Appl. No.: 503,297

[52] U.S. Cl. ..... 214/16.1 A; 244/115; 52/65; 214/16.1 CC

[51] Int. Cl.[2] ..... E04H 6/06

[58] Field of Search ..... 244/114 R, 115, 116; 52/65; 214/16.1 A, 16.1 CC; 296/1 A

[56] References Cited

UNITED STATES PATENTS

| | | | |
|---|---|---|---|
| 1,818,957 | 8/1931 | Adams | 214/16.1 CC |
| 1,847,549 | 3/1932 | Adams | 214/16.1 CC |
| 2,463,744 | 3/1949 | Clemens | 214/16.1 CC X |
| 2,483,078 | 9/1949 | Williams | 244/115 |
| 3,599,809 | 8/1971 | Gresham | 214/16.1 A |
| 3,675,795 | 7/1972 | Dluhy | 214/16.1 CC |
| 3,737,057 | 6/1973 | Neumann et al. | 214/16.1 A |

FOREIGN PATENTS OR APPLICATIONS

| | | | |
|---|---|---|---|
| 1,402,867 | 5/1965 | France | 214/16.1 A |
| 506,737 | 5/1939 | United Kingdom | 244/114 R |
| 242,293 | 12/1962 | Australia | 214/16.1 CC |
| 1,449,658 | 7/1966 | France | 52/65 |
| 1,183,232 | 1/1959 | France | 214/16.1 A |
| 202,597 | 8/1923 | United Kingdom | 214/16.1 A |

*Primary Examiner*—Robert J. Spar
*Assistant Examiner*—R. B. Johnson
*Attorney, Agent, or Firm*—Cahill, Sutton & Thomas

[57] ABSTRACT

A hangar system for compactly storing a plurality of vertically oriented sailplanes upon a rotatable annular platform, including means for withdrawing or inserting any one of the sailplanes without repositioning the remaining sailplanes.

11 Claims, 4 Drawing Figures

SAILPLANE STORAGE SYSTEM

The present invention relates to storage facilities for airplanes and, more particularly, to a system for storing sailplanes.

Most fixed base operators provide hangar space or other covered storage facilities for airplanes based at their airports. Because of the airplanes' configuration, it is difficult to store them in a compact manner. When an effort is made to crowd as many airplanes as possible within any given storage facility, removal of any selected one of the airplanes becomes a difficult and time consuming task; to do so, all of the airplanes blocking passage of the selected airplane must be wheeled outside of the hangar or otherwise repositioned within the hangar to allow removal. During the ground handling operation, it is not uncommon and almost unavoidable to have one airplane bush or otherwise contact another airplane. Each contact invariably scrapes the paint at the point of contact and often results in a dent. These paint scrapes and dents are generally referred to in the trade as hangar rash.

Owners who exercise meticulous care in maintaining their airplanes and those who use their airplanes for competitive purposes are highly intolerant of hangar rash. Because of the resulting ill feeling between airplane owners and fixed base operators, various hangar systems have been developed in an effort to preclude the necessity of removing or repositioning one or more airplanes to obtain access to a selected airplane. One of the most common types of hangars is that of a barracks-like building having a plurality of individual rectangular shaped spaces, each space being allotted to a single airplane. Such a hangar avoids hangar rash and affords selective removal of any given airplane; however, it is extremely wasteful of ground space and the cost of the necessary real estate requires very high hangar rental fees. To reduce the ground space requirements, serially aligned interleaved T-shaped hangars are sometimes used. They provide storage capability for more airplanes per acre of ground but they are more expensive to construct because of their unique configuration.

To further increase the ground space utilization factor, various types of circular hangars have been devised for radially storing a few (four to six) airplanes. Means have also been incorporated within these circular hangars to permit selective egress of any one of the airplanes. To increase the utilization factor and airplane density, the airplanes have been tilted a few degrees whereby the wing tips of one airplane overlap the wing tips of adjacent airplanes. In yet further modifications, multi storied circular hangars have been employed.

The following U.S. Pat. Nos. are representative of the above described types of hangars: 1,855,834, 2,964,144, 3,398,843 and 3,670,464. Hangar systems employing positionable platforms for automatically conveying airplanes to a selected position within a story of multi storied hangars have also been developed, as illustrated in U.S. Pat. No. 3,675,378.

For sailplanes, few if any of the existing hangars for power airplanes are either practical or feasible. Presently, most fixed based operators operating sailplane facilities store the sailplanes within a large hangar or else store them outside. If the sailplanes are stored within a hangar, the problems of hangar rash are always present. In fact, hangar rash becomes more of a problem for sailplanes as the wing spans are generally greater than that of most private power airplanes.

Most sailplanes presently flying in the United States fall within a category known as Standard Class. These sailplanes are limited to wing spans of 15 meters (49.2 feet) and have fuselages of approximately 20 feet in length. The aspect ratio of these sailplanes is generally between 20 to 25. To store sailplanes of this configuration in a compact manner while eliminating hangar rash to the utmost extent is essentially impossible in the widely used large rectangular hangars.

It is therefore a primary object of the present invention to provide an economical covered storage facility for sailplanes.

Another object of the present invention is to provide a means for storing sailplanes which precludes the occurrence of hangar rash.

Still another object of the present invention is to provide a means for selectively storing and retrieving sailplanes from within a hangar without requiring repositioning of adjacent sailplanes.

Yet another object of the present invention is to provide a means for efficiently storing a plurality of sailplanes within the confines of a given ground area.

A further object of the present invention is to provide a means for randomly inserting sailplanes within a hangar while retaining a selective retrieve capability.

A still further object of the present invention is to provide a storage facility having a transport system for inserting and withdrawing sailplanes.

A yet further object of the present invention is to provide equipment facilities, workshop space and a supply room within a sailplane hangar without impeding or derogating from the sailplane storage capability of the hangar.

These and other objects of the present invention will become apparent to those skilled in the art as the description thereof proceeds.

The present invention may be described with greater specificity and clarity with reference to the following drawings, in which.

Most of the sailplanes owned and flown by private sailplane pilots are ships which fall within the category of Standard Class sailplanes; that is, sailplanes having a wing span of 15 meters (49.2 feet) and which conform to certain other requirements. Because of the number of these sailplanes and the potential hangar rental income they represent, many fixed base operators have constructed rectangular hangars for storing them. However, most owners prefer to dismantle their sailplanes after use and store them within their own covered trailers to avoid potential hangar rash. The dismantling of the sailplane at the end of a day's flying with the requisite reassembly when the airplane is to be flown again is a nuisance but one which most sailplane owners have been forced to accept. The present invention, as described below, offers a viable alternative and will satisfy a long felt demand in the pertaining market.

Figures 1, 2:
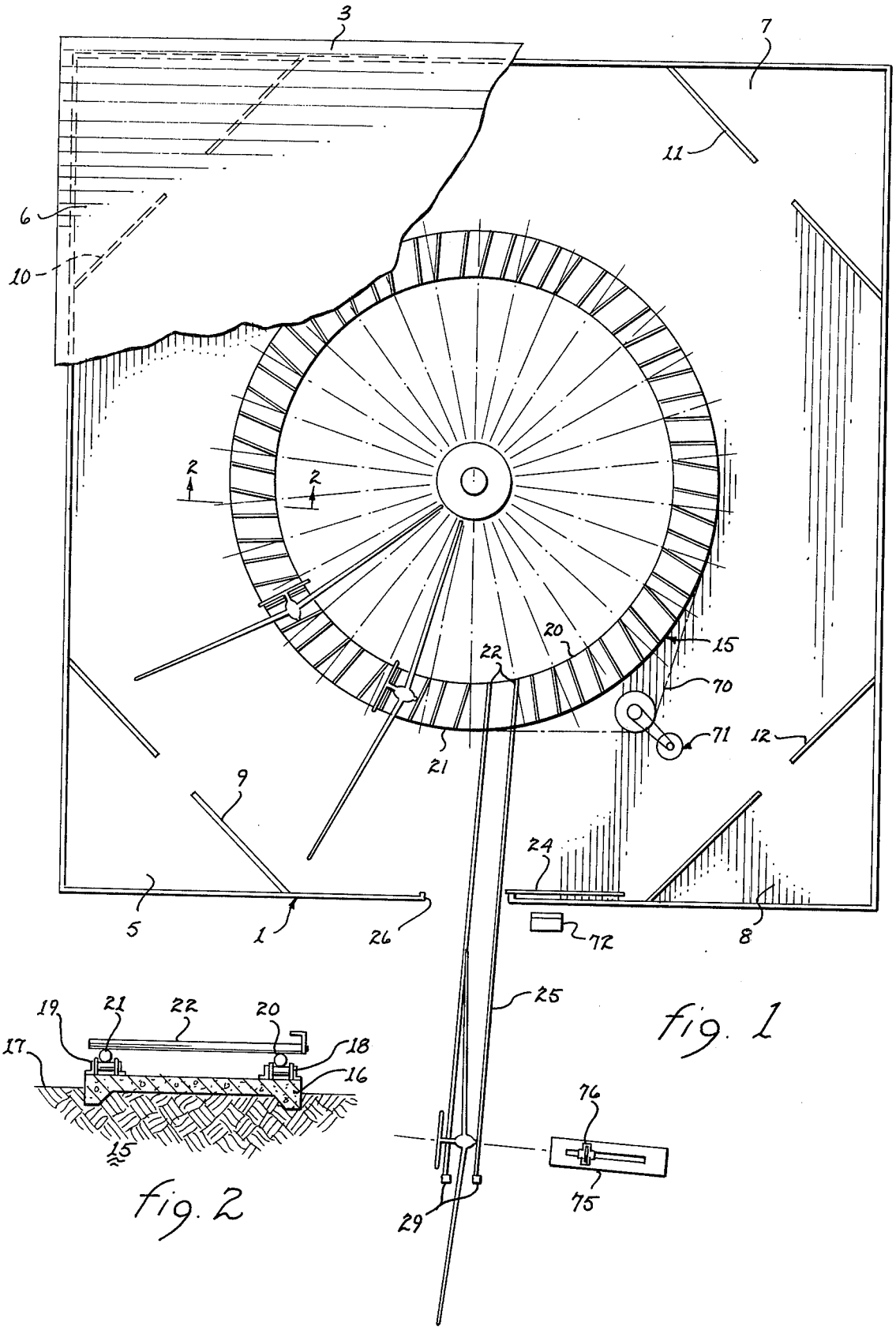
FIG. 1 is a cutaway top view of the present invention.
FIG. 2 is a cross-sectional view of the rotatable platform taken along lines 2—2, as shown in FIG. 1.

Referring to FIG. 1, there is shown a sailplane hangar 1 constructed in accordance with the teachings of the present invention and which circumvents the basis giving rise to hangar rash. In addition, the present invention permits the erection of a centrally located vertical support 2 for roof 3. The central support obviates the necessity for employing roof trusses which span the width of the hangar. Instead, half width trusses can be used which bring about a substantial savings in the material and construction costs. For reasons which will become evident below, the floor space necessary to store the sailplanes is circular with a radius approximately equivalent to the span of the stored sailplanes, that is, a radius of approximately 50 feet. As the hangar may be constructed in the shape of a square, a substantial part of each corner floor space 5, 6, 7 and 8 is not needed for storage of the sailplanes. These corner spaces may be segregated by means of walls 9, 10, 11 and 12 and used as office space, supply storage, workshops and the like. In existing hangars, the use of floor space for these purposes would severely restrict the storage density and detract from the revenue generating capability of the hangar.

A rotatable annular platform 15 is centrally located within hangar 1 and will be described with joint reference to FIGS. 1 and 2. The foundation 16 for the platform is embedded within the floor 17 of hangar 1 or it may be formed as a part thereof. A first set of spaced rollers 18 are mounted in radial alignment along the inner periphery of foundation 16. A second set of spaced rollers are mounted in radial alignment along the outer periphery of foundation 16. The first set of rollers 18 supports a circular track 20 and the second set of rollers 19 supports a further circular track 21. Each of a plurality of pairs of cross tracks 22 extend across circular tracks 20 and 21 and are secured thereto. In this manner, the circular tracks are retained concentric to one another and in fixed spacial relationship to prevent dislodgement from the respective sets of rollers. Each pair of cross tracks 22 are non-aligned with respect to one another and set at an angle of approximately 2° to 3° with respect to a radial passing therethrough. The angle selected for the pairs of cross tracks is essentially an average of the dihedral angle of the inboard wing of the sailplanes to be stored upon the present invention in order that the inboard wing of a stored sailplane be approximately radially aligned, as shown. The circumferential distance along each platform allotted to each pair of cross tracks is somewhat more than the total height of a stored sailplane. In example, if the radius of platform 15 is about 50 feet, each pair of cross tracks would subtend an arc of about 12°. Thus, 30 Standard Class sailplanes could be stored in the illustrated embodiment.

A feeder track 25 extends from the periphery of platform 15 through a doorway 26 within one wall of hangar 1 to a point at least 25 feet removed from the exterior wall of the hangar. The feeder track is of the same width as the pairs of cross tracks 22 and is set in alignment therewith. The feeder track will be described in further detail with reference to FIGS. 1 and 3. It is formed of a pair of rails 27 and 28 mounted upon a foundation 29. The foundation is coextensive with the length and width of the feeder track and, where circumstances permit, may be formed as a part of the floor of hangar 1 and the ground surface extending in front of the hangar. A sliding door 24 mates with doorway 26 to seal the hangar from the elements.

Carrier 30, supporting a sailplane 31, will be described with joint reference to FIGS. 1, 3 and 4. It includes a generally rectangular framework base 36 having corners 48, 49, 58, 59. Each of a pair of shafts 37 and 38 extend from corners 48, 49, respectively, on one side of base 36 and rotatably support rollers 32 and 33, respectively, which rollers rest upon rail 27. Similarly, each of a pair of shafts extend from corners 58 and 59 on the opposite side of base 36 to rotatably support rollers 34 and 35, respectively, which rollers rest upon rail 28. The rollers, 32, 33, 34 and 35 may include radial flanges to ensure against derailing.

An open ended inverted nose cone 40 is centrally disposed upon base 36 and retained immobile by braces 41, 42, 43 and 44. A pair of beams 45 and 46 extend upwardly from corners 58 and 59 of base 36 and are secured to one another at apex 47. A wheel support 50 is secured to and extends transverse to beams 45 and 46. A channel 57 extends intermediate apex 47 annd wheel support 50 to guide the wheel 39 of the sailplane to and from the wheel support. An open ended truncated cone shaped fuselage retainer 51 is removably or pivotally mounted at apex 47. Retainer 50 is constructed as a pair of split cone halves hinged to each other by a hinge 52 and lockably secured to another by a locking mechanism 53. A pair of tabs 54 and 55 extend from beams 45 and 46, respectively, in a direction opposite to that of wheel support 50 and support a receiver or rod 56 therebetween.

A beam 60 extends upwardly from corner 48 of base 36 and is braced to beam 45 by brace 62. A wing support 61 is attached to the upper extremity of beam 60 which attachment is strengthened by one or more gussets 63. A similar beam 65 extends upwardly from corner 49 of base 36 and is supported by a brace 66 extending from beam 46. A wing support 67 is attached to the extremity of beam 65, which attachment may be strengthened by one or more gussets 68.

Figure 3:
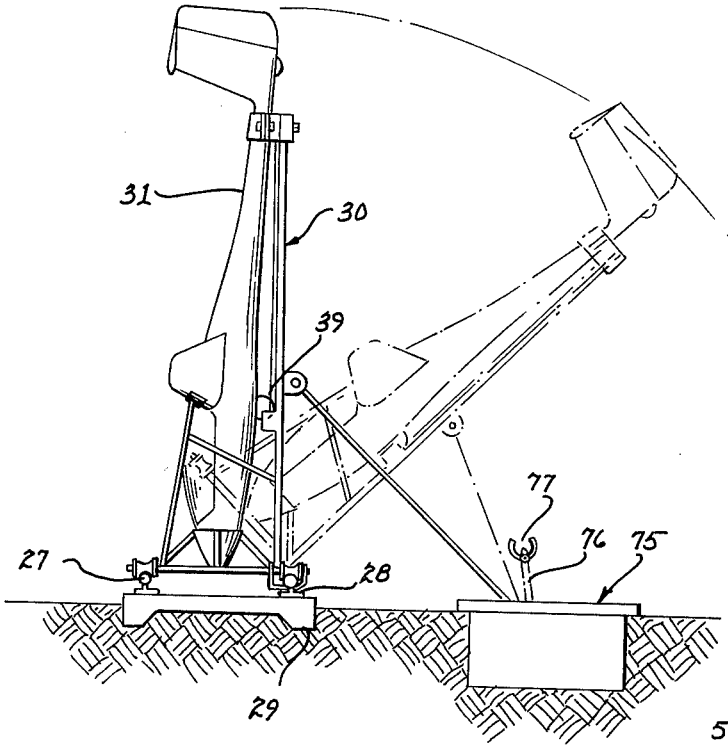
FIG. 3 illustrates a sailplane carrier pivotable about one rail of a feeder track.
Figure 4:
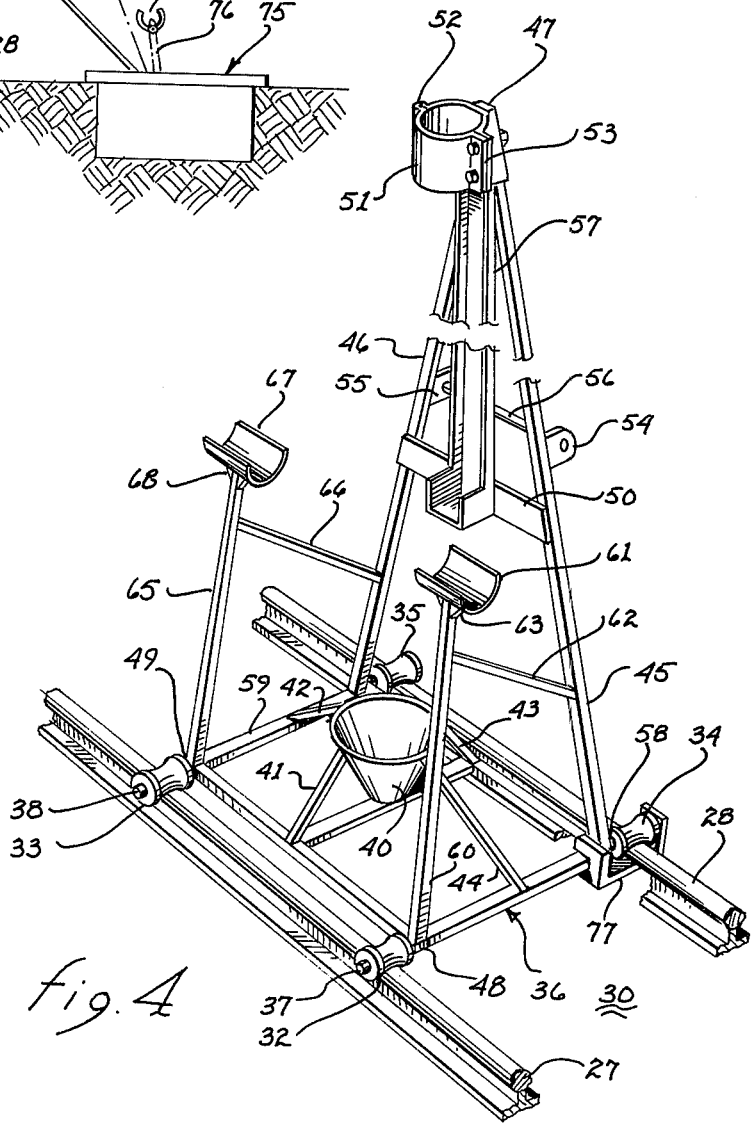
FIG. 4 is a detailed view of the sailplane carrier mounted upon the feeder track.

As best illustrated in FIG. 3, the combination of nose cone 40, wheel support 50, retainer 51 and wing supports 61 and 67 provide multiple points of support for sailplane 31 to allow pivoting of carrier 30 from the horizontal to the vertical position and vice versa and to retain the sailplane in the vertical position without damage. It will be appreciated that the relative dimensions between the nose, the wings, the main wheel and the aft part of the fuselage vary with different types of sailplanes. Therefore, each carrier 30 must be specifically dimensioned to receive a particular manufacturer's sailplane. That is, a certain carrier configuration will accommodate all ASW-15's while another configuration will accommodate all Libelles, and so forth.

To pivot carrier 30 from the horizontal to the vertical position and return, a hydraulic system 75 is used, as shown in FIG. 1 and 3. A ram 76 is configured to receive and lockably engage a receiver or rod 56 of carrier 30. As the ram is extended or contracted, the carrier will pivot about rail 28 and remain in contact therewith through rollers 34 and 35. To assure against disengagement with rail 28, the arms of a U-shaped locking device 77 engage the extremity of the shaft supporting roller 34 and corner 58 of base 36. The center section of locking device 77 extends beneath rail 28 and prevents movement of roller 34 lateral to the rail. If deemed prudent, a similar locking device may be used in conjunction with roller 35 to ensure against undesired sideways tilting of carrier 30.

To provide insertion or retrieval of a selected sailplane, annular platform 15 is rotated until the pair of cross tracks 22 supporting the pertinent carrrier 30 is aligned with feeder track 25. The rotation of annular platform 15 is performed by means of a motorized gear or belt system 71. As such systems are well known to those skilled in the art, structural details thereof need not be described. Suffice it to say that energization of the motor will produce a corresponding movement of belt 70 and commensurate rotation of annular platform 15. Actuation of system 71 is accomplished through a control console 72 disposed external to hangar 1. Thereby, an operator can manipulate the pertaining controls within console 72 to align the selected pair of cross tracks 22 with the feeder track 25.

Normally, each of carriers 30 are mounted upon their respective pairs of cross tracks 22, whether or not they are presently supporting a sailplane. To insert a sailplane within hangar 1, the following procedure is used. The operator would manipulate the controls upon console 72 to align the carrier corresponding to the sailplane to be inserted with feeder track 25. The carrier is manually rolled off its pair of cross tracks and onto feeder tracks 25 and there along to the stops 29 at the extremity of the feeder track. The hydraulic system 75 is energized to extend ram 76 until the latter contacts and lockably engages rod 56. Simultaneously, locking device 77 is attached to ensure continuous engagement of roller 34 with rail 28. Further operation of hydraulic system 75 retracts ram 76 and pivots carrier 30 downwardly about rail 28 until the carrier rests upon the ground. Retainer 51 is disengaged from apex 47 so as not to impede rolling the sailplane onto carrier 30. Wheel 39, on engagement with channel 57, guides the sailplane until further forward movement is simultaneously restricted by wheel support 50, nose cone 40 and wing supports 61 and 67. When the sailplane has reached this position, retainer 51, after having been opened, is secured about the aft fuselage of the sailplane and remounted upon apex 47. The normal taper of the aft fuselage, in combination with the form fitting configuration of retainer 51, restricts rearward movement of the sailplane. Thereby, unwanted forward or rearward movement of the sailplane is inhibited. Wing supports 61 and 67 also prevent lateral pivotal movement of the sailplane.

After the sailplane has been secured to carrier 30, hydraulic system 75 is energized to extend ram 76. Extension of ram 76, pushing against rod 56, pivots the carrier upwardly until rollers 32, 33, 34 and 35 rest upon their respective rails 27 and 28. In this position, the sailplane is vertical and its weight is supported by the nose cone 40, wing supports 61, 67 and wheel support 50, which multiple supports adequately distribute the weight of the sailplane to prevent damage thereto. Once the carrier 30 has been pivoted into the vertical position, the ram 76 is detached from rod 56 and retracted by the hydraulic system 75. The carrier can now be manually pushed along feeder track 25 into hangar 1 and onto its pair of cross tracks 22.

Rotation of platform 15 will subject the mounted carriers, whether loaded or unloaded, to a certain centrifugal force. To prevent outward radial movement of the carriers, the pairs of cross tracks are set at an angle to slope downwardly toward the locus of platform 15. A lip 23 (see FIG. 2) is disposed at the inner extremity of each of pairs of cross tracks 22. This lip serves two purposes. First, it restricts the inward movement of carrier 30; second, it extends over the adjacent roller (i.e. rollers 33 and 35) to prevent tilting of the carrier.

To withdraw a sailplane from within hangar 1, the appropriate controls are effected at console 72 to produce rotation of platform 15 until the sought sailplane is aligned with feeder track 25. The carrier mounted sailplane is withdrawn by manually transporting its carrier from the pair of cross tracks and along feeder track 25 to stops 29. The hydraulic system 75 is energized to extend ram 76 for locking engagement with rod 56. Simultaneously, locking device 77 is secured about one or both of rollers 34 and 35. Further energization of hydraulic system 75 results in retraction of ram 76 and downward pivotal movement of carrier 30 until the latter rests upon the ground. By unlocking retainer 51 from about the rear of the fuselage and disengaging it from apex 47, the sailplane can be rolled rearwardly off the carrier. Once the sailplane is clear of the carrier, the latter is pivoted to the vertical position until it again rests upon rails 27 and 28. After locking device 77 is removed, the carrier is pushed back unto its pair of cross tracks 22 and another selected sailplane may be withdrawn or another sailplane may be inserted within the hangar.

From the above description of the operation, it becomes evident that no sailplane need be relocated within the hangar to remove or insert any selected sailplane, regardless of how filled the hangar may be. Rotataion of platform 15 does not in any manner give rise to hangar rash as the mounted sailplanes are retained spaced apart from one another at all times and are essentially immobile with respect to one another. Thus, the present invention precludes contact between sailplanes. From the above description it also becomes evident that the sailplane density for any given surface area is greater than that possible by any known existing airplane storage facilities, whether they be directed to power planes or sailplanes.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A hangar system for storing a plurality of vertically oriented sailplanes in radial alignment about a center point within a hangar, said hangar system comprising:

a. a selectively rotatable circular platform disposed within the hangar;

b. a plurality of pairs of cross tracks mounted upon said platform, each of said pairs of cross tracks being generally radially alingned upon said platform;

c. a feeder track extending from the periphery of said platform external to the hangar through an opening in a side wall of the hangar, said feeder track being in alignment with one of said pairs of cross tracks at the periphery of said platform;

d. means for incrementally rotating said platform to position any one of said pairs of cross tracks into alignment with said feeder track at the periphery of said platform;

e. a carrier for supporting one of the sailplanes within the hangar and whenever the sailplane is moved onto or off of said platform and along said feeder track, said carrier being mounted upon one of said pairs of cross tracks and movable therefrom along said feeder track when the respective one of said pair of cross tracks is in alignment with said feeder track, said carrier including means for maintaining the longitudinal axis of the sailplane in vertical alignment and the wings of the sailplane in general lateral alignment with the direction of travel of said carrier; and f. means disposed in proximity to said feeder track for pivoting said carrier in a vertical plane to load and unload a sailplane from the pivoting one of said carriers when said one carrier is positioned upon said feeder track; whereby, the hangar stores a plurality of vertically oriented and radially aligned sailplanes upon said platform and permits individual insertion and withdrawal of any sailplane without inserting or withdrawing any other sailplane.

2. The hangar system as set forth in claim 1 wherein the tracks of each said pair of cross tracks are parallel and each said pair of cross tracks are secured to said platform at an angle with respect to a radial to position the inboard wing tip of a carrier supported sailplane in proximity to the center point of said platform.

3. The hangar system as set forth in claim 2 wherein said pairs of cross tracks includes means for inhibiting the tilting of any of said carriers mounted thereon.

4. The hangar system as set forth in claim 3 wherein said carrier comprises a base having a plurality of rollers extending therefrom for movably supporting said carrier upon either said cross tracks or said feeder track and said support means comprises a superstructure for providing a multi point support for a vertically or horizontally oriented sailplane.

5. The hangar system as set forth in claim 1 wherein said carrier comprises a base, a superstructure extending upwardly from said base for engaging and supporting a sailplane, and roller means extending from said base for rotatably supporting said carrier upon either said pairs of cross tracks or said feeder track.

6. The hangar system as set forth in claim 5 wherein said superstructure includes means for supportingly engaging a sailplane in proximity to the wing root, the wheel and aft fuselage.

7. The hangar system as set forth in claim 5 wherein said superstructure comprises a nose cone, a pair of wing saddles, a wheel support and an aft fuselage retainer.

8. The hangar system as set forth in claim 6 wherein said carrier includes a channel for guiding the wheel of the sailplane during loading and unloading of said carrier and wherein said fuselage retainer extends from said channel and is removably engageable with the aft fuselage to accommodate passage of the wheel therepast.

9. The hangar as set forth in claim 1 wherein the radius of said platform is at least 25 feet.

10. The hangar as set forth in claim 9 wherein each of said pairs of cross tracks are disposed upon a segment of said platform, which segment subtends an angle of 12° whereby said platform can accommodate 30 Standard Class sailplanes.

11. The hangar as set forth in claim 10 wherein each of said pairs of cross tracks is set at an angle of 3° with respect to a radial of said platform passing therethrough, which angle is commensurate with the dihedral of the inboard wing and positions the inboard wing upon a radial of said platform.

* * * * *